US009173035B2

(12) United States Patent
Button

(10) Patent No.: US 9,173,035 B2
(45) Date of Patent: Oct. 27, 2015

(54) DUAL COIL MOVING MAGNET TRANSDUCER

(71) Applicant: Harman International Industries, Incorporated, Stamford, CT (US)

(72) Inventor: Douglas J. Button, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 56 days.

(21) Appl. No.: 14/074,491

(22) Filed: Nov. 7, 2013

(65) Prior Publication Data

US 2015/0125025 A1 May 7, 2015

(51) Int. Cl.

| | |
|---|---|
| ***H04R 1/00*** | (2006.01) |
| ***H04R 9/02*** | (2006.01) |
| ***H04R 11/02*** | (2006.01) |
| *H04R 9/06* | (2006.01) |

(52) U.S. Cl.

CPC .. *H04R 9/02* (2013.01); *H04R 1/00* (2013.01); *H04R 9/025* (2013.01); *H04R 11/02* (2013.01); *H04R 9/022* (2013.01); *H04R 9/063* (2013.01)

(58) Field of Classification Search

USPC ..... 381/420, 401, 397

See application file for complete search history.

(56) References Cited

U.S. PATENT DOCUMENTS

| | | | | |
|---|---|---|---|---|
| 1,797,965 | A | 3/1931 | Peterson | |
| 4,237,347 | A * | 12/1980 | Burundukov et al. | 369/136 |
| 5,008,945 | A * | 4/1991 | Murayama et al. | 381/409 |
| 5,734,132 | A * | 3/1998 | Proni | 181/171 |
| 5,748,753 | A * | 5/1998 | Carver | 381/96 |
| 5,748,760 | A | 5/1998 | Button | |
| 5,828,767 | A | 10/1998 | Button | |
| 6,307,287 | B1 | 10/2001 | Garrett et al. | |
| 6,665,414 | B1 * | 12/2003 | Murayama et al. | 381/397 |
| 6,768,806 | B1 | 7/2004 | Button et al. | |
| 6,774,510 | B1 | 8/2004 | Moro et al. | |
| 6,847,726 | B2 | 1/2005 | Button et al. | |
| 6,870,454 | B1 * | 3/2005 | Vladimirescu et al. | 335/220 |
| 7,012,345 | B2 | 3/2006 | Moro et al. | |
| 7,095,485 | B2 | 8/2006 | Hol et al. | |
| 7,149,323 | B2 * | 12/2006 | Yamagishi | 381/415 |
| 8,014,555 | B2 | 9/2011 | Hyde et al. | |
| 8,199,962 | B2 * | 6/2012 | Maeda | 381/398 |

(Continued)

FOREIGN PATENT DOCUMENTS

| | | | |
|---|---|---|---|
| DE | 3027586 | A1 | 2/1982 |
| DE | 102009052129 | A1 | 5/2011 |
| KR | 1020080004956 | A | 1/2008 |

OTHER PUBLICATIONS

European Patent Office, Extended European Search Report Issued in European Patent Application No. 14191794.8, May 7, 2015, 6 pages.

*Primary Examiner* — Davetta W Goins
*Assistant Examiner* — Amir Etesam
(74) *Attorney, Agent, or Firm* — Alleman Hall McCoy Russell & Tuttle LLP

(57) ABSTRACT

Embodiments are disclosed for driving an electromagnetic transducer via a drive unit comprising stationary coils and a moving magnet. In some embodiments, an electromagnetic transducer comprises a diaphragm configured to generate acoustic vibrations, a moving magnet affixed to the diaphragm, and a pair of fixed coils surrounding the moving magnet, the fixed coils configured to direct electrical current in opposite directions.

20 Claims, 9 Drawing Sheets

(56) References Cited

U.S. PATENT DOCUMENTS

| | | | |
|---|---|---|---|
| 8,325,943 | B2 | 12/2012 | Button et al. |
| 2002/0071587 | A1 | 6/2002 | Wang |
| 2004/0156527 | A1 | 8/2004 | Stiles et al. |
| 2005/0123166 | A1 | 6/2005 | Chen et al. |
| 2007/0237351 | A1 | 10/2007 | Hyde et al. |
| 2013/0010999 | A1 | 1/2013 | Lastrucci |

* cited by examiner

DUAL COIL MOVING MAGNET TRANSDUCER

FIELD

The disclosure relates generally to electromagnetic transducers and particularly to loudspeakers.

BACKGROUND

In a transducer, energy of one form is converted to energy of a different form. Electroacoustic transducers convert electrical impulses to acoustic vibrations that may be perceived as audible sound to proximate listeners. Some such electroacoustic transducers are electromagnetic transducers driven electromagnetically by a drive unit comprising a permanent magnet and a voice coil having a plurality of wire windings. Here, electrical signals supplied to the voice coil generate a magnetic field that interacts with the magnetic field generated by the permanent magnet, inducing motion in the voice coil. As the voice coil is affixed to a diaphragm, this motion may be conveyed to the diaphragm to produce sound.

SUMMARY

Embodiments are disclosed for driving an electromagnetic transducer via a drive unit comprising stationary coils and a moving magnet. In some embodiments, an electromagnetic transducer comprises a diaphragm configured to generate acoustic vibrations, a moving magnet affixed to the diaphragm, and a pair of fixed coils surrounding the moving magnet, the fixed coils configured to direct electrical current in opposite directions.

In additional or alternative embodiments, an electromagnetic transducer comprises a surround affixed to a housing, a diaphragm affixed to the housing and configured to produce acoustic vibrations, a coupler affixed to the diaphragm, a permanent magnet affixed to the coupler and having a bore aligned to a central axis, and a coil comprising a first coil portion and a second coil portion. The first and second coil portions concentrically surround the permanent magnet and are configured to induce motion in the permanent magnet about the central axis responsive to directing electrical signals in opposite directions.

In some embodiments, a method for driving an electromagnetic transducer comprises directing electrical signals through a pair of coils in opposite directions, inducing motion in a permanent magnet via magnetic fields produced by the directed electrical signals and the permanent magnet, the induced motion constrained to a central axis via a linear bearing affixed to a rear surface of a housing. The method further comprises maintaining the pair of coils in a fixed position and generating acoustic vibrations by imparting the induced motion to a diaphragm coupled to the permanent magnet.

BRIEF DESCRIPTION OF THE DRAWINGS

The disclosure may be better understood from reading the following description of non-limiting embodiments, with reference to the attached drawings, wherein below.

DETAILED DESCRIPTION

As described above, electroacoustic transducers convert electrical impulses to acoustic vibrations that may be perceived as sound by proximate listeners. Some electroacoustic transducers include electromagnetic drive units comprising a permanent magnetic and a voice coil having a plurality of wire windings. Electrical signals fed to the voice coil generate magnetic fields that interact with the magnetic field of the permanent magnet to induce motion in the voice coil. The voice coil is affixed to a diaphragm to convey induced motion to the diaphragm in order to produce sound. Such topologies, however, generally utilize powerful permanent magnets and are prone to degradation due to voice coil movement.

In some such approaches which use a moving voice coil, a powerful permanent magnet is provided by using a magnet comprised of a material exhibiting a high magnetic flux density such as a neodymium alloy. Material costs significantly increase with the use of neodymium, however, relative to other magnet materials. In other approaches, the high material cost of neodymium may be avoided by using a permanent magnet comprised of an aluminum, nickel, and cobalt alloy, referred to as alnico. The magnetic flux density of an alnico magnet is significantly less than that of a neodymium magnet, however. To compensate this reduction in magnetic field strength, the mass of the alnico magnet may be increased, but at the expense of increased loudspeaker weight.

The output of an electroacoustic transducer may be increased with an electromagnetic drive unit comprising stationary dual coils and a moving magnet, while reducing potential points of degradation and magnet mass. The magnet may be a reduced-mass permanent magnet comprised of a neodymium alloy. Alternatively, the magnet may be comprised of other materials including but not limited to an alnico alloy.

Figure 1:
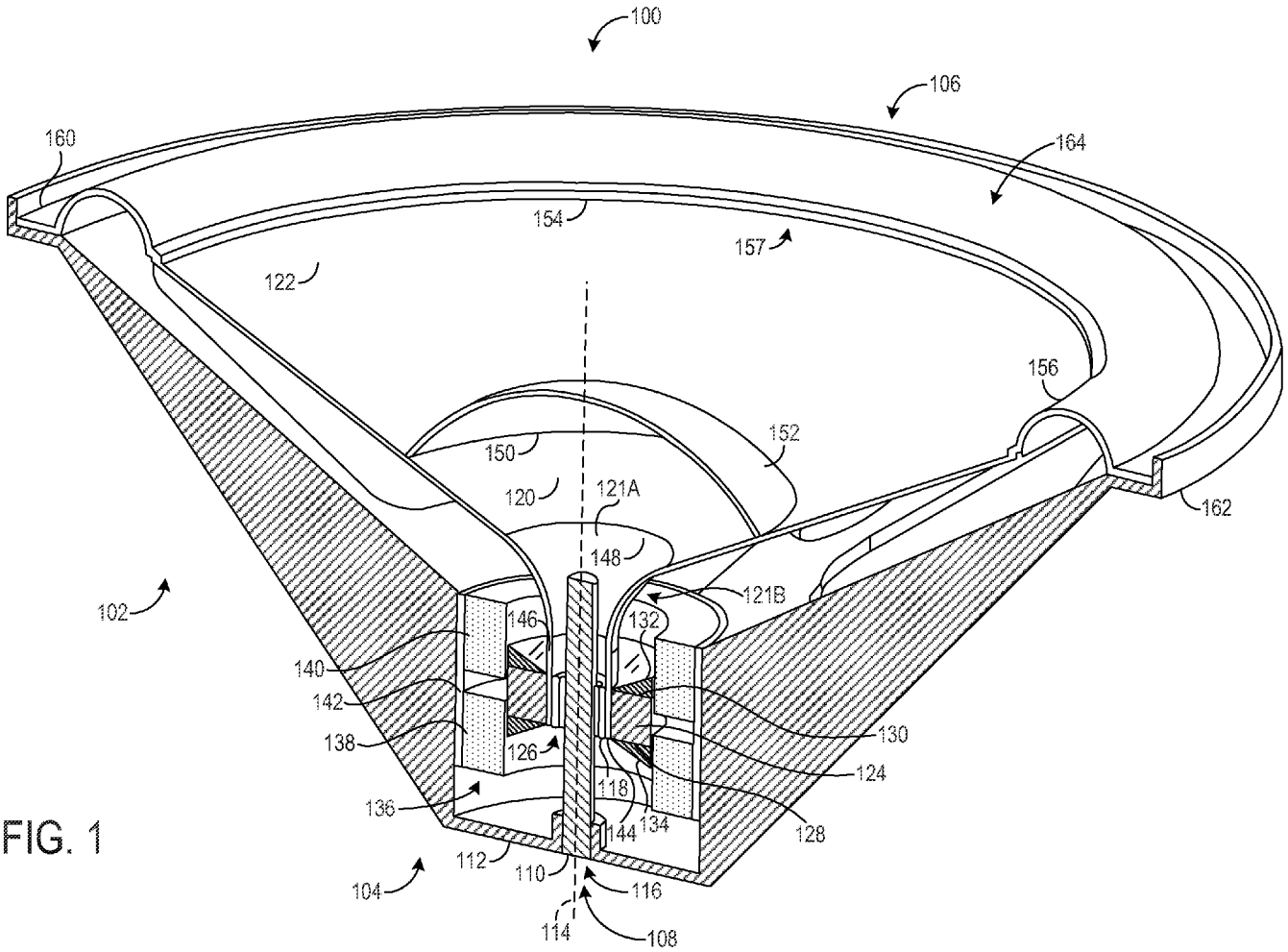
FIG. 1 is a sectional view of a loudspeaker in accordance with one or more embodiments of the present disclosure.

FIG. 1 shows a sectional view of an electromagnetic transducer 100 in accordance with an embodiment of the present disclosure. Electromagnetic transducer 100 is configured in this example to generate acoustic vibrations, and may also be referred to as a loudspeaker. Loudspeaker 100 may be configured to produce acoustic waves in a plurality of frequency ranges. For example, loudspeaker 100 may generate audible sound in a frequency range from 20 Hz to 200 Hz, in which case the loudspeaker may be classified as a subwoofer.

Loudspeaker 100 includes a housing 102, extending from a rear end 104 of the loudspeaker to a front end 106 of the loudspeaker. The housing generally provides a stable, fixed structure to which moving and non-moving components may be affixed. While the housing may be in a stationary environment (such as a room), or a mobile environment (such as a vehicle), the non-moving components of loudspeaker 100 include those that are substantially fixed relative to the housing, and the moving components include those that are not substantially fixed relative to those housing such that they can move relative to the housing, as described in further detail below. In one example, components substantially fixed to the housing may be coupled to the housing via fasteners, welding, overmolding, etc. Similarly, components not substantially fixed to the housing may be coupled to the housing through a relatively flexible connection.

The housing at least partially encloses, and may fully enclose, other components that may also undergo motion or remain at a fixed position relative to the housing. Housing 102 may be comprised of one or more thermally conductive materials (e.g., aluminum) such that heat generated by coils described below may be efficiently dissipated. As the power and volume produced by the loudspeaker is in part limited by heat, effective thermal dissipation may aid in increasing loudspeaker output. As described in further detail below, a heat sink structure may be affixed to housing 102 to further assist in heat dissipation.

Loudspeaker 100 further includes a linear bearing 108 facilitating electromagnetically-induced motion in the loudspeaker. Linear bearing 108 includes a shaft 110 affixed to rear end 104 of the loudspeaker. In particular, shaft 110 is oriented perpendicularly with respect to a rear surface 112 of housing 102, and defines a central axis 114 of the loudspeaker about which other components described below may undergo electromagnetically-induced motion to generate acoustic vibrations in the loudspeaker. Shaft 110 may be embedded or otherwise coupled to housing 102 in various suitable ways—for example, the shaft may inserted through a rear bore 116 in rear surface 112 and glued or screwed in place, with a rear surface of the shaft substantially (e.g., within 5 mm) flush with rear surface 112. In other embodiments, however, shaft 110 may be integrally formed with housing 102 as a single, unitary unit. Shaft 110 in this example is cylindrical, though other geometries are possible.

Linear bearing 108 also includes a sheath 118 concentrically positioned to surround shaft 110 and central axis 114, and remain in sliding contact with the shaft. Sheath 118 in this example is annular and comprises a plurality of flutes (not shown) regularly positioned along its inner surface. Such a configuration allows sheath 118 to move in two directions along central axis 114 and shaft 110 while producing low amounts of friction and facilitating air transfer as sheath movement occurs. Sheath 118 and/or linear bearing 108 may be comprised of one or more low friction materials (e.g., Teflon) to facilitate such motion. Alternatively, the exterior surfaces of sheath 118 and/or shaft 110 may be coated with one or more low-friction materials.

As traversed radially outward from central axis 114, a coupler 120 concentrically surrounds the central axis and sheath 118, and translates electromagnetically-induced motion to a diaphragm 122. Coupler 120 includes an interior surface 121A which generally faces upwardly and positively along central axis 114, and an exterior surface 121B opposite the interior surface that generally faces downwardly and negatively along the central axis. Interior surface 121A faces a dome, diaphragm, surround, and portions of a frame, while exterior surface 121B faces components which are operable to drive loudspeaker output including a magnet, magnet pole pieces, coil portions, and a sleeve. The operation and design of these components are described in further detail below.

A magnet 124 concentrically surrounds coupler 120, sheath 118, and shaft 110. In the illustrated embodiment, magnet 124 has a central bore 126 through which portions of coupler 120, sheath 118, and shaft 110 are inserted. In particular, the inner surface of magnet 124 formed by central bore 126 is affixed to the exterior surface of coupler 120, which may be carried out in various suitable manners (e.g., gluing, welding, etc.). Magnet 124 is thus annular and has a rear surface 128 which, in this example, is substantially (e.g., within several millimeters) flush with the lower ends of coupler 120 and sheath 118.

In the illustrated embodiment, magnet 124 is comprised of an alloy including Neodymium, Iron, and Boron (e.g., $Nd_2Fe_{14}B$) and thus may be considered a permanent magnet exhibiting a relatively high magnetic flux density. As such, a magnet having a reduced mass may be provided which generates the same magnetic field strength as other higher-mass permanent magnets comprised of different materials (e.g., alnico). Other material compositions for the magnet are within the scope of the present disclosure, however, including but not limited to alnico, ceramic, ferrite, and samarium-cobalt. Reduced mass in magnet 124 may further increase the output of loudspeaker 100 as loudspeaker output is in part limited by the mass of its moving parts. As described below in further detail, magnet 124 provides a magnetic field that, with other elements, facilitates electromagnetic transduction of electrical signals into motion of the magnet along central axis 114. As magnet 124 undergoes motion along central axis 114, this motion may then be conveyed by coupler 120 and sheath 118 to diaphragm 122 where acoustic vibrations are generated.

Affixed respectively to rear surface 128 of magnet 124, and to a front surface 130 of the magnet, is a front pole piece 132 and a rear pole piece 134. In this embodiment, front and rear pole pieces 132 and 134 are annular, comprised of steel, and are ferromagnetic. Other material compositions are possible, however. Front and rear pole pieces 132 and 134 supplement the magnetic field generated by magnet 124 and thus increase the efficiency of the loudspeaker. In this embodiment, front and rear pole pieces 132 and 134 comprise flat portions which are in face-sharing contact with opposite sides of magnet 124, and angled portions which angle inward toward central axis 114 and face away from magnet 124.

As shown in FIG. 1, front and rear pole pieces 132 and 134 have a triangular cross-section with a varying thickness. The thickness of each pole piece decreases as they are traversed radially inward toward central axis 114. This configuration affords an increase in magnetic field strength while limiting the increase of mass due to the inclusion of the pole pieces. Other geometries and configurations are possible; in other embodiments the pole pieces may be annular and have a thickness which does not change as the pole pieces are traversed radially inward. Additional modifications may be made to the pole pieces. For example, the pole pieces may be coated with copper sheathing to reduce distortion in the audio produced by the loudspeaker as well as its inductance, which may expand the range of frequencies the loudspeaker is operable to produce. In some embodiments, however, front and rear pole pieces may be omitted to reduce the moving mass in the loudspeaker.

Loudspeaker 100 further includes a coil 136 comprising a first coil portion 138 and a second coil portion 140. Generally, coil 136 is operable to induce motion in magnet 124 (along with front and rear pole pieces 132 and 134, coupler 120, diaphragm 122, and sheath 118) along central axis 114 in response to receiving electrical signals. More particularly, variations in electrical signals received at coil 136 may interact with the magnetic field produced by magnet 124 to generate forces and thus movement in the magnet, which may then be conveyed to diaphragm 122 to produce audible sound.

In the illustrated embodiment, first and second coil portions 138 and 140 are annular and concentrically surround magnet 124. The first and second coil portions each comprise a plurality of wire windings, which may be comprised of copper or aluminum, for example. The plurality of wire windings of first coil portion 138 are configured to direct electrical current in a direction opposite the direction in which the plurality of wire windings of second coil portion 140 are configured to direct electrical current.

Figure 2:
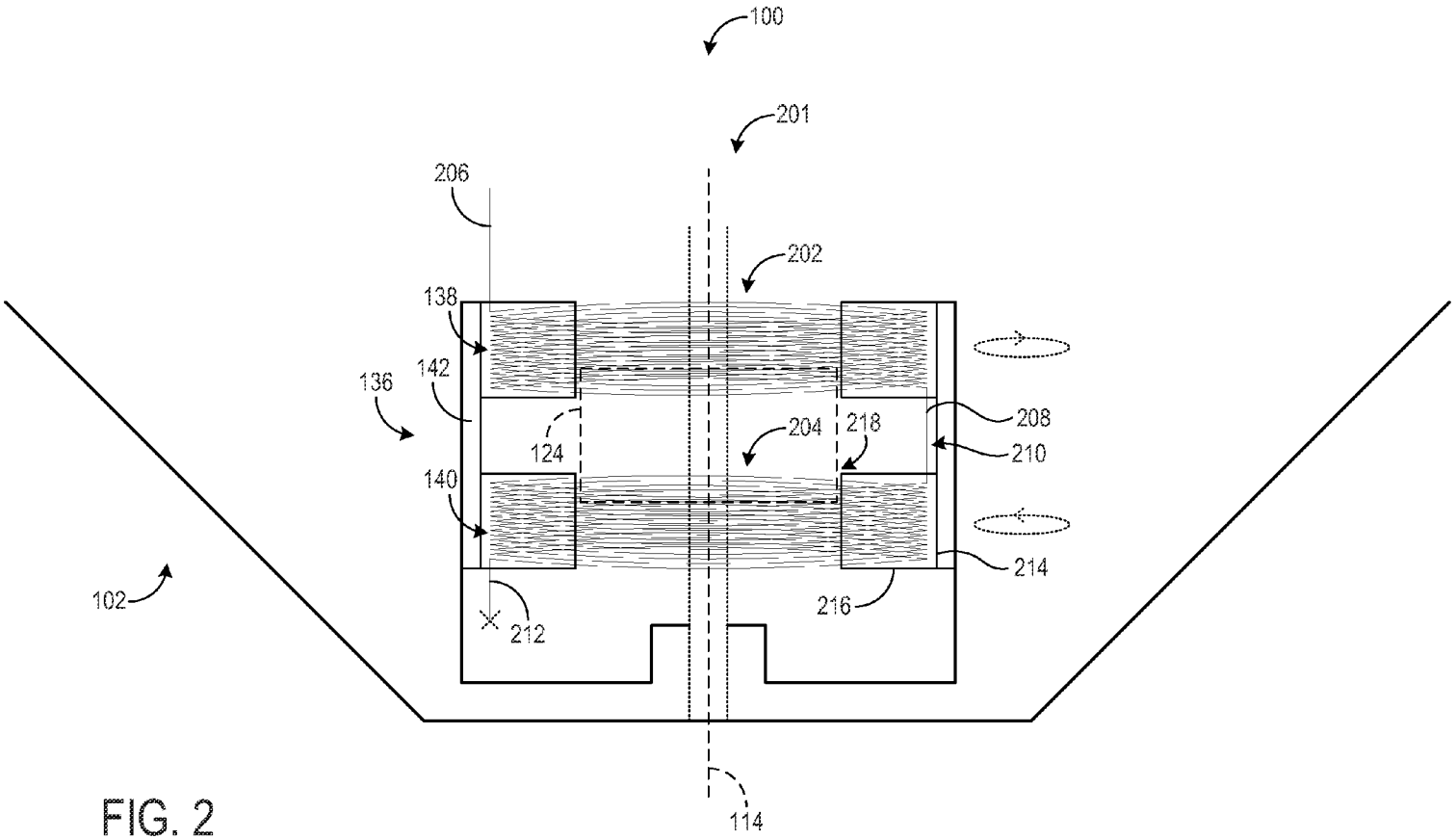
FIG. 2 schematically shows a drive unit of a loudspeaker in accordance with one or more embodiments of the present disclosure.

Turning now to FIG. 2, a front view of a cross-section of loudspeaker 100 taken along central axis 114 is schematically shown, illustrating a drive unit 201 of the loudspeaker. In particular, wire windings 202 of first coil portion 138, wire windings 204 of second coil portion 140, and their attachment are shown in schematic form, representing one exemplary configuration by which electrical current may be directed in opposite directions throughout the coil portions. A send wire 206 forms the initial portion of coil 136, descending vertically in alignment with central axis 114 in this example. Send wire 206 then is coiled in a clockwise direction about central axis 114 a predetermined number of times, culminating in a vertical wire portion 208 spanning a vertical space 210 between the first and second coil portions. Vertical wire portion 208 then initiates wire windings 204 of second coil portion 140, which are wound in a counter-clockwise direction opposite the direction in which wire windings 202 of first coil portion 138 are wound. In this embodiment, the number of wire windings in the first and second coil portion 140 is equal, though unequal numbers of windings are possible. The number of windings in the coil portions may be varied according to various desired loudspeaker characteristics. Second coil portion 140 then culminates in a return wire 212, which is schematically shown as exiting loudspeaker 100 into the page of FIG. 2. Send and return wires 206 and 212 may be fed to a suitable adapter (e.g., tag) to which leads carrying electrical signals may be connected. In this embodiment, first and second coil portions 138 and 140 are thus electrically coupled in series and wound out of phase. Alternatively, first and second coil portions 138 and 140 may be electrically in parallel.

First and second coil portions 138 and 140 are wound in opposite directions so that the force imparted to magnet 124 by each coil portion, responsive to the reception of electrical signals at send and return wires 206 and 212, is approximately in the same direction. Utilizing such a dual coil configuration aids in maximizing loudspeaker power while reducing weight. The Lorentz force law applied to current-carrying wires illustrates this advantage. The magnitude of force on a current-carrying wire carrying a current (i) along a wire (of length L) in a direction perpendicular to an external magnetic field (B) is equal to (i*L*B). Here, a reduction in the magnitude of the magnetic field B by using a permanent magnet (e.g., magnet 124) of reduced mass may be compensated by increasing L, the length of the current-carrying wire. In the illustrated embodiment, this is accomplished by using two coil portions, which also reduces cost by reducing the required amount of magnetic material. Increased loudspeaker output with reduced mass may be further aided by using a neodymium magnet.

It will be appreciated that the configuration schematically illustrated in FIG. 2 is shown for illustrative purposes and is not intended to be limiting in any way. Some aspects of this configuration shown in FIG. 2 are exaggerated for the sake of clarity, such as the appearance of first and second coil portions 138 and 140, in order to illustrate their structure and winding directions. Moreover, first and second coils portions 138 and 140 may be affixed to various locations when wound. For example, the coil portions may be glued to an inner surface 214 of a coil housing 216 during winding (which may correspond to a coil-facing surface of sleeve 142 described below), or to a proximate surface of housing 102. Still further, send wire 206, return wire 212, and first and second coil portions 138 and 140 may be comprised of a single continuous wire or two or more separate but electrically coupled wires.

Approximate alignment of the forces imparted to magnet 124 by first and second coil portions 138 and 140 may be achieved via alternative coil configurations. For example, coil portions not wound in opposite directions may be provided. To achieve approximate alignment of forces imparted by the coil portions, current itself may flow in one coil portion in a direction opposite the direction in which current flows in another coil portion. Opposing current flow between the coil portions may be effected by driving each coil portion with separate, respective amplifiers operating in reverse phase with respect to each other. In this embodiment, wire windings comprising each coil portion are not electrically coupled, but rather are separate elements having their own send and return leads.

As shown in FIGS. 1 and 2, first and second coil portions 138 and 140 are vertically spaced apart a distance away from each other (e.g., as measured along central axis 114). First and second coil portions 138 and 140 also concentrically surround magnet 124, which, when at rest (e.g., during times in which electrical signals are not fed to the coil portions), may vertically center itself centrally between the coil portions as illustrated in FIG. 1. During these times of rest, and when the magnet is driven by the coil portions, the magnet acts as a flexible, compressible magnetic spring due to the magnetic properties of the magnet and a magnetic sleeve described below. As such, loudspeaker 100 lacks a spider which would otherwise flexibly restore magnet deflection (or in typical loudspeaker approaches voice coil deflection). Problems which arise in a spider may thus be avoided (e.g., material fatigue, deformation, etc.). Moving elements in the loudspeaker (e.g., sheath 118, coupler 120, magnet 124, etc.) may experience an expanded range of motion relative to loudspeakers which employ a spider. As these components may be relatively less restricted in their motion, so too may be diaphragm 122 and its resultant acoustical output. Embodiments are nevertheless possible in which a spider or other flexible retainer is employed and coupled, for example, between an upper portion of front pole piece 132 and a lower portion of diaphragm 122.

First and second coil portions 138 and 140 are also spaced away from magnet 124 (and pole pieces 132 and 134) in a direction traversed radially outward from central axis 114. As seen in FIG. 2, this spacing manifests in an annular gap 218 provided between the magnet and the coil portions. The size of annular gap 218 may be selected based on various desired parameters; for example, the size of the annular gap may be minimized to reduce the amount of heat-insulating air between magnet 124 and first and second coil portions 138 and 140, increasing the heat dissipation capabilities of the loudspeaker.

Additional aspects of the dual coil configuration shown in FIGS. 1 and 2 increase heat dissipation in loudspeaker 100. Whereas in other loudspeaker designs the coils typically undergo and translate motion to a diaphragm to produce sound, first and second coil portions 138 and 140 are maintained in a fixed position with respect to housing 102. As such, dissipating heat generated in the coil portions is simpler and more effective. Moreover, the distribution of heat generated by first and second coil portions 138 and 140 is increased as a greater coil surface area is provided by the dual coil configuration. As heat may be dissipated more efficiently in loudspeaker 100, the maximum output of the loudspeaker may be increased.

As shown in FIGS. 1 and 2, loudspeaker 100 further includes a sleeve 142 which is interposed between and in contact with coil 136 and an inner portion of housing 102. Geometrically, sleeve 142 in this example is a thin ring or annulus with a height spanning the heights of first and second coil portions 138 and 140, and the vertical distance (e.g., along central axis 114) separating the coil portions. Sleeve 142 may be comprised of a material such as steel, and is ferromagnetic. Sleeve 142 forms a return portion of a magnetic circuit due to its proximity to other magnetic components (e.g., magnet 124, first and second pole pieces 132 and 134, etc.). In this magnetic circuit, some magnetic field lines toward a right side of magnet 124 may extend from and out of a north pole of the magnet, upwardly and rightward through first coil portion 138 and into sleeve 142, downward through sleeve 142, leftward and upwardly through second coil portion 140, and back into the magnet at its south pole. By providing a magnetic flux return path for the north and south poles of magnet 142, a deflectable magnetic spring is provided, allowing the magnet to be deflected in the presence of electrical current and naturally resume neutral positioning in the absence of electrical current.

Continuing with FIG. 1, coupler 120, introduced above, is interposed between sleeve 142 and magnet 124, and is configured to convey induced motion in the magnet to diaphragm 122 to thereby generate acoustic waves. Coupler 120 has a rear end 144 which in this example is substantially flush (e.g., within 5 mm) with the rear end of magnet 124. Extending from its rear end 144, coupler 120 includes a cylindrical section 146 concentrically surrounding an upper portion of shaft 110 and central axis 114. As traversed upwardly along central axis 114, cylindrical section 146 joins a funnel section 148 which fans outwardly in a smooth, continuous manner. In particular, the inner diameter of funnel section 148 increases as central axis 114 is traversed upwardly.

In the illustrated embodiment, the vertical position of sheath 118 along central axis 114, which controls the vertical position of coupler 120 and the degree to which diaphragm is deflected along the central axis, remains within a range along shaft 110 of linear bearing 108. This range is a subset of the overall height of shaft 110, preventing the moving assembly of parts from extending too low or high, and may be defined by a variety of parameters including but not limited to friction between sheath 118 and the shaft, the stiffness of diaphragm 122 and its coupling to surround 156, etc.

At an upper coupler circumference 150, coupler 120 is affixed to diaphragm 122 and a dome 152. Geometrically, dome 152 in this example is a truncated sphere, though other geometries are possible (e.g., parabolic). Dome 152 protects components of loudspeaker 100 which drive diaphragm 122 and keeps out materials which would otherwise directly or indirectly damage such components (e.g., dust and other debris).

As described above, diaphragm 122 is a conical and smooth membrane configured to generate acoustic vibrations by pushing proximate air responsive to electrical signals applied to coil 136. In this embodiment, diaphragm 122 is concave, angling inward toward central axis 114 and having a diameter which increases as the central axis is traversed upwardly. As described below, other arrangements are possible, however. Both dome 152 and diaphragm 122 may be comprised of the same materials (e.g., paper) or different materials.

Affixed to coupler 120 at a first (e.g., rear) end, diaphragm 122 is further affixed to a surround 156 at a second (e.g., front) end at an inner diaphragm circumference 154, the surround extending circumferentially around front end 106 of loudspeaker. In this example, a cross-section of surround 156 forms approximately a annular-shaped half cylinder and includes a flange 157 on its inner side (e.g., toward central axis 114), which are raised step-like ridges interposed between the surround and diaphragm 122. Surround 156 facilitates flexible but stable motion of diaphragm 122, and may assist in the dissipation of acoustic waves propagating along the periphery of loudspeaker 100. At an outer diaphragm circumference 160, surround 156 is coupled to a frame 162, which occupies a front portion of housing 102. Frame 162 in this embodiment comprises a flat annular ring with a perpendicular ridge positioned radially outward from and in contact with the flat annular ring.

As shown and described, loudspeaker 100 is operable to produce high-fidelity audio at high volumes while reducing weight by using magnet 124 to drive motion in diaphragm 122 and minimizing the use of heavy materials (e.g., steel). The operating headroom of loudspeaker 100 is further increased by various heat dissipation optimizations, such as spatially-fixed coils. These advantages may be realized in a plurality of environments and scenarios, including but not limited to a home audio sound system, concert venues, sport arenas, etc. Loudspeaker 100 is also compatible with a large range of existing audio equipment and does not require signal processing specific to its design to achieve the above advantages. Nevertheless, unique signal processing may be performed to optimize audio output.

Figure 3:
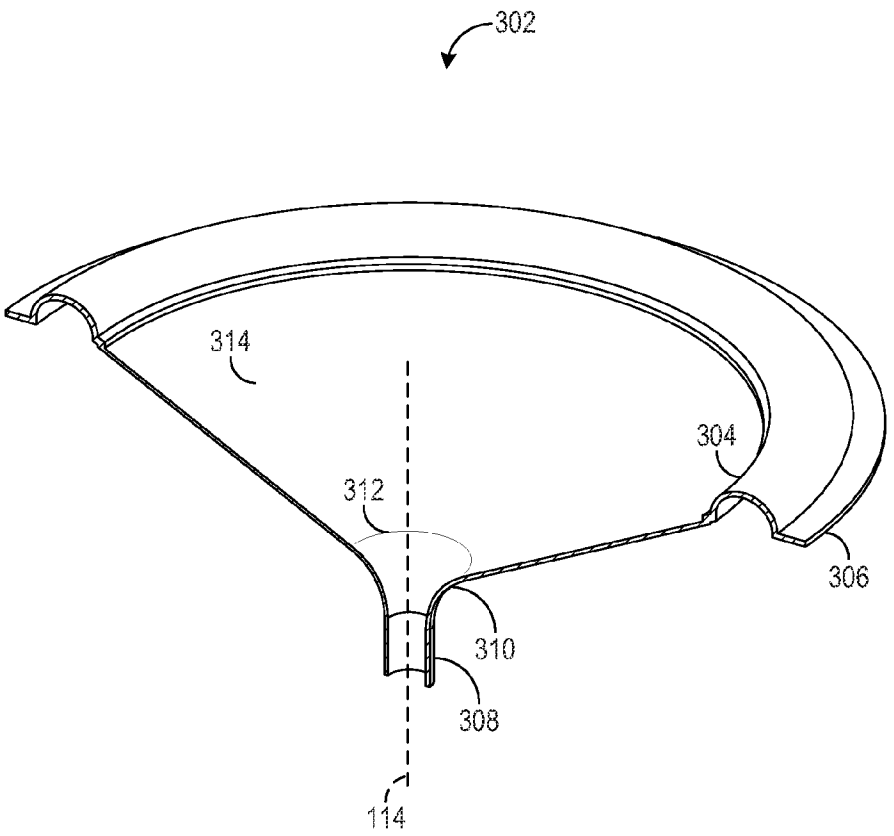
FIG. 3 is a sectional view of an integrated coupler-diaphragm in accordance with one or more embodiments of the present disclosure.

Various modifications may be made to loudspeaker 100. For example, coupler 120 and diaphragm 122 may be integrally formed as a single, unitary, contiguous unit. FIG. 3 shows a sectional view of an embodiment of an integral coupler-diaphragm 302, along with portions of a surround 304 and a frame 306, which may respectively be surround 156 and frame 162 in FIG. 1. As with diaphragm 122 shown in FIG. 1, integral coupler-diaphragm 302 in this example includes a cylindrical section 308 which smoothly transitions to a funnel section 310. The height of cylindrical section 308, measured along central axis 114, is relatively small compared to the overall height of integral coupler-diaphragm 302, and has a diameter sized to accommodate the insertion of a sheath and bearing shaft (not shown), such as sheath 118 and shaft 110 in FIG. 1. In some embodiments, the height of cylindrical section 308 may be less than the height of funnel section 310.

In the illustrated embodiment, funnel section 310 has a diameter that increases as central axis 114 is traversed upwardly in a smooth manner. Thus, funnel section 310 has a lesser diameter at an end proximate cylindrical section 308 than its diameter at an opposite end. The curvature of funnel section 310 may assume various forms such as a parabolic or hyperbolic form, which may be selected for various acoustic and/or packaging reasons. At a front end 312, the geometry of funnel section 310 then smoothly transitions to and contiguously joins a diaphragm 314. In this example, diaphragm 314 is a conical surface having a diameter which increases as central axis 114 is traversed upwardly. Diaphragm 314 may be diaphragm 122 in FIG. 1, for example.

Integral coupler-diaphragm 302 may be formed in various suitable manners and may comprise various materials. In some embodiments, the integral coupler-diaphragm is formed with injection-molded plastic. In other embodiments, the integral-coupler diaphragm is formed with spun or drawn aluminum. Although integral coupler-diaphragm 302 exhibits a funnel-like geometry, other geometries are possible and may be selected based on various desired parameters.

Figure 4:
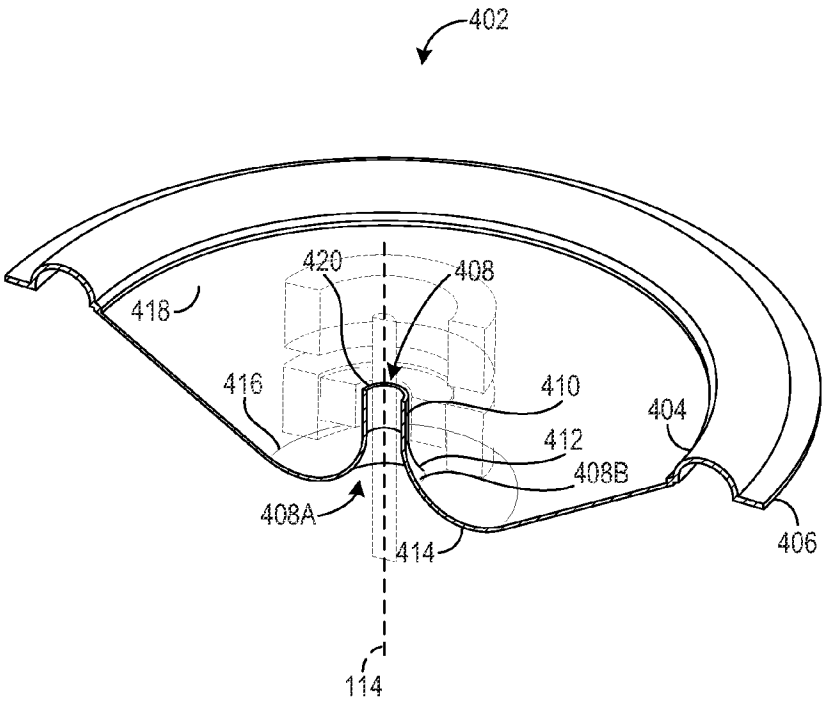
FIG. 4 is a sectional view of an inverted coupler-diaphragm in accordance with one or more embodiments of the present disclosure.

FIG. 4 shows a sectional view of an embodiment of an inverted coupler-diaphragm 402 along with portions of a surround 404 and a frame 406, which may respectively be surround 156 and frame 162 in FIG. 1. In the illustrated embodiment, inverted coupler-diaphragm 402 includes an inverted coupler 408 which has an inverted funnel-like geometry including a cylindrical section 410 which smoothly transitions to an inverted funnel section 412 whose diameter increases as central axis 114 is traversed downwardly. A vertex point 414 designates a region at which surrounding portions of coupler 408 (both radially inward and outward from the vertex point) curve upwardly along central axis 114. At a rear end 416 of coupler 408, radially outward from vertex point 414, the coupler is joined to a relatively flat, conical diaphragm 418 where the prominent curvature of the coupler ceases. The diameter of coupler 408 at rear end 416 may be relatively large with a corresponding reduction in the size of diaphragm 418, compared to other loudspeaker configurations (e.g., loudspeaker 100 in FIG. 1).

Inverted coupler-diaphragm 402 may be integral coupler-diaphragm 302 of FIG. 3 oriented in a substantially reversed direction about the central axis, for example, and formed in the manners described above (e.g., contiguously or separately). In this embodiment, loudspeaker components which induce motion and thus acoustic vibrations may be successively positioned in a direction opposite the direction in which they are positioned shown in FIG. 1. To illustrate such positioning, the inclusion of a magnet, dual coil portions, and linear bearing shaft are schematically illustrated in FIG. 4. Here, a magnet is centrally positioned about cylindrical section 410 of coupler 408. The magnet is shown in a deflected state relative to its surrounding coil portions for the sake of clarity. Particularly, a front (e.g., upper in the figure) surface of the magnet may be approximately flush with a front end 420 of coupler 408. The magnet may be concentrically surrounded by vertically separated coil portions whose rearmost surface (e.g., lowest surface relative to central axis 114) may radially intersect a region of funnel section 412 of coupler 408. A front surface (e.g., highest surface relative to central axis 114) of the coil portions may intersect diaphragm 418 at a region proximate its attachment to surround 404 or a region above the uppermost point of surround 404. In further contrast to non-inverted loudspeaker 100 shown in FIG. 1 and particularly coupler 120, inverted coupler 408 includes an interior surface 408A that generally faces downwardly and negatively along central axis 114, and an exterior surface 408B opposite the interior surface that generally faces upwardly and positively along the central axis. Interior surface 408A particularly faces a dome (not shown), diaphragm 418, surround 404, and portions of a frame 406, while exterior surface 408B faces components of an electromagnetic drive described above, including the magnet and coil portions. As shown, diaphragm 418 is operable to travel, via its attachment to inverted coupler 408, the substantial length of the linear bearing shaft without contacting the lower coil portion or another region of the loudspeaker motor.

It will be appreciated that additional components shown in FIGS. 1 and 2 may be combined with inverted coupler-diaphragm 402 to form a loudspeaker, such as a sheath, sleeve, magnet pole pieces, etc. Inverted loudspeaker configurations in accordance with this embodiment may yield a more compact profile with reduced packaging space compared to non-inverted configurations.

Figure 5:
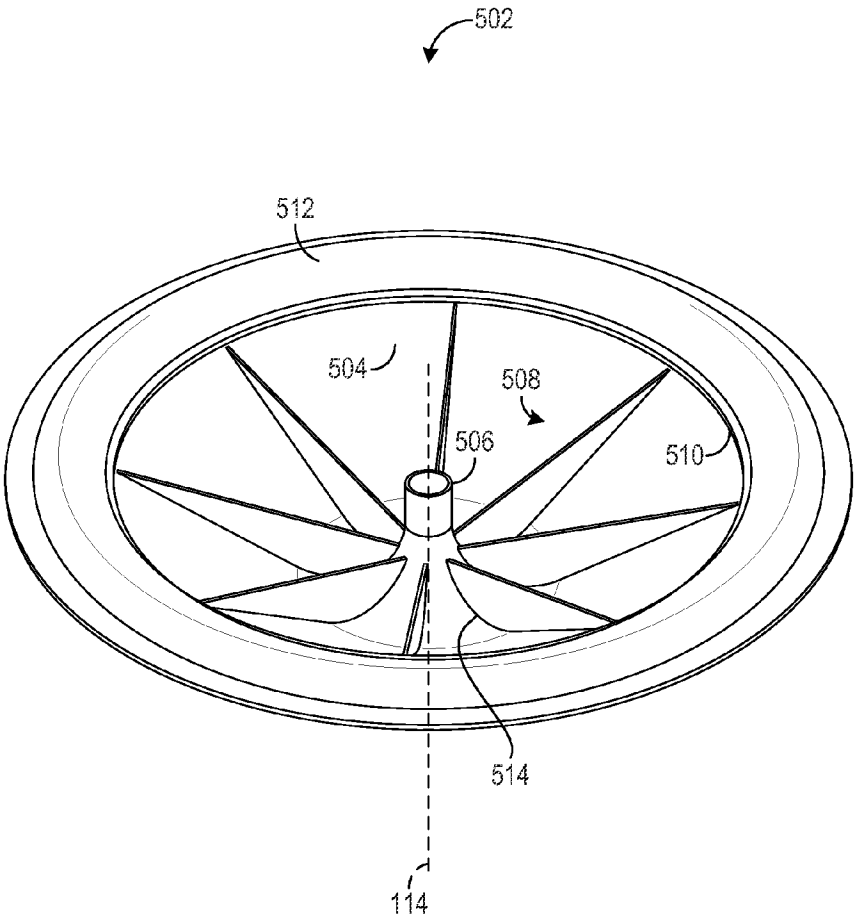
FIG. 5 is a perspective view of a loudspeaker including diaphragm ribs in accordance with one or more embodiments of the present disclosure.

FIG. 5 shows a perspective view of an embodiment of a loudspeaker 502 which includes a concave diaphragm 504, an inverted coupler 506 coupled thereto, and a plurality of geometric features 508 disposed on the surface of the diaphragm. Particularly, the plurality of geometric features 508 includes eight partially triangular ribs extending radially outward from the curved, funnel-like surface of inverted coupler 506 to a corrugation 510 of a surround 512, which may be surround 156 in FIG. 1, for example. In this example, ribs 508 span the diameter of diaphragm 504 and have heights (e.g., as measured along central axis 114) which decrease as the ribs extend radially outward from the central axis. Ribs 508 further comprise curved bases (e.g., base 514) contoured to the exterior surface of coupler 506. Matching the geometric profile of coupler 506 with that of the bases of ribs 508 provides structural stability and an engaging appearance without adversely affecting acoustic performance.

Ribs 508 may be integrally formed with one or both of diaphragm 504 and coupler 506, or may be formed as separate elements and subsequently attached. It will be appreciated that a variety of geometric features in various numbers may be disposed on the surface of diaphragm 504, which may be selected for various aesthetic and acoustic reasons. As the geometry of coupler 506 may be varied, so too may the bases of geometric features attached to the coupler such that their connecting surfaces remain contoured to each other.

In the depicted embodiments, such as loudspeaker 100 shown in FIG. 1, diaphragm 122 extends concavely inward below a front surface 164 of surround 156. As loudspeaker 100 includes non-inverted coupler 120, the coupler, diaphragm 122, magnet 124, and coil 136 are positioned such that motion induced in the magnet and diaphragm generates acoustic vibrations propagating toward front surface 164 of surround 156 (e.g., upwardly along central axis 114). Other arrangements are possible, however.

Figure 6:
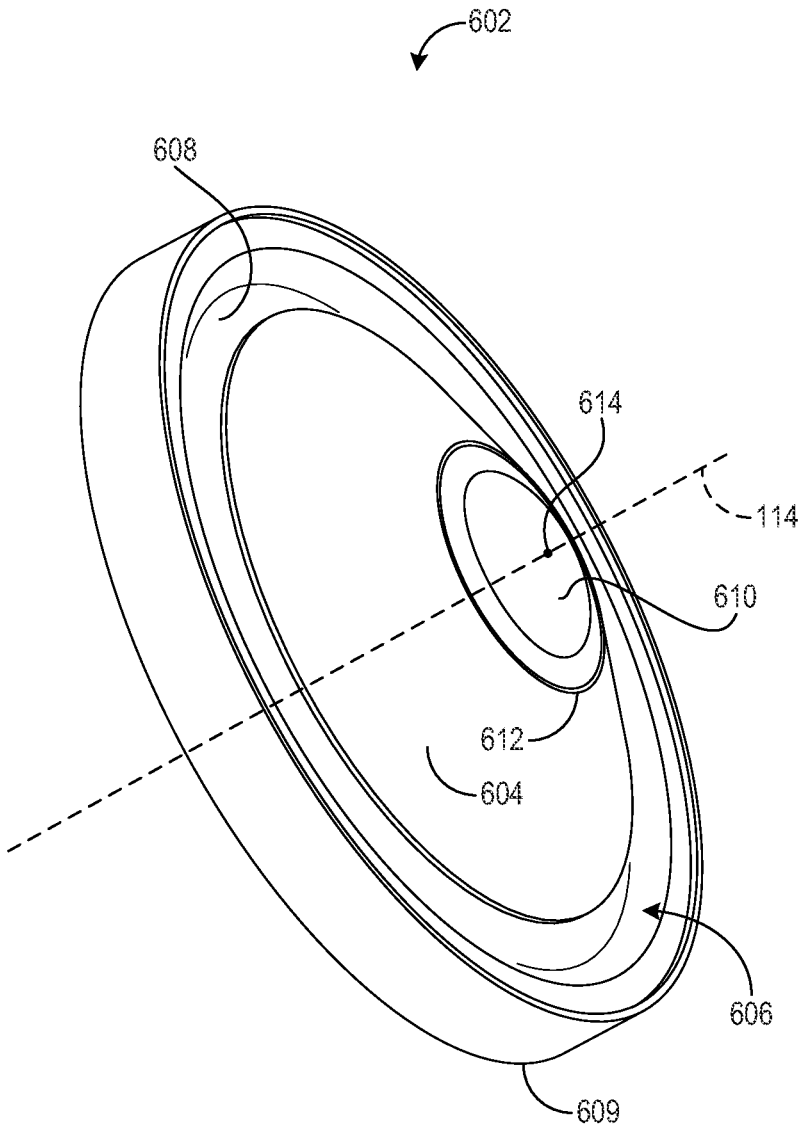
FIG. 6 is a perspective view of an inverted loudspeaker in accordance with one or more embodiments of the present disclosure.

Turning now to FIG. 6, a perspective view of an embodiment of an inverted loudspeaker 602 is shown. In contrast to the embodiments shown and described above, inverted loudspeaker 602 includes an inverted diaphragm 604 which extends convexly outward above a front surface 606 of an inverted surround 608 to which the diaphragm is affixed. The diameter of inverted diaphragm 604 decreases as central axis 114 is positively traversed (e.g., upwardly and rightward in FIG. 6). Conversely, inverted surround 608 extends concavely inward toward central axis 114 and has a geometry of a half-cylinder, providing a contrasting recessed region interposed between an annular frame 609 of the loudspeaker and convex, inverted diaphragm 604.

Inverted loudspeaker 602 further includes a non-inverted coupler (not shown) having a funnel section whose diameter increases as central axis 114 is traversed upwardly (e.g., positively). Moreover, a convex, outwardly extending dome 610 is affixed to a front end 612 of diaphragm 604 and aligned with central axis 114. As described above with reference to dome 152 in FIG. 1, dome 610 protects diaphragm 604 and other internal loudspeaker components, and may be comprised of the same material from which the diaphragm is formed. In some embodiments, dome 610 may have a relatively pronounced curvature compared to that of diaphragm 604, and may have a point 614 forming the most raised portion of loudspeaker 602. In other words, the height of point 614, measured along central axis 114, may exceed the height of all other points in loudspeaker 602. With this configuration, loudspeaker 602 is configured such that motion induced in a magnet (not shown) generates acoustic vibrations propagating away from front surface 606 of surround 608. Loudspeaker 602 may provide a reduced packaging space without adversely impacting acoustic performance.

Figure 7:
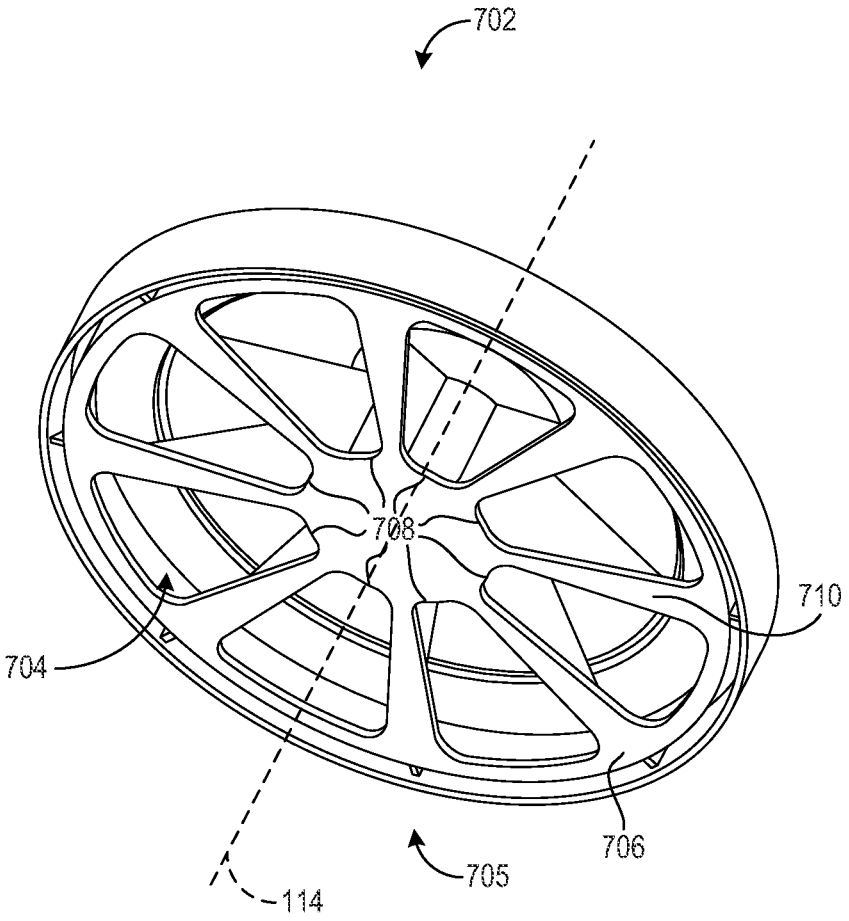
FIG. 7 is a perspective view of a loudspeaker positioned in a housing in accordance with one or more embodiments of the present disclosure.

FIG. 7 shows a perspective view of an embodiment of a housing 702 surrounding a loudspeaker 704. Housing 702 affords protection to the various components of loudspeaker 704, provides a stable structure to which some components may be affixed, increases heat dissipation in the loudspeaker, and provides an engaging appearance. To facilitate heat dissipation, housing 702 may be comprised of a thermally conductive material such as aluminum. As a further aid to heat dissipation, and enhancement of aesthetic appearance, housing 702 includes a rear surface 705 having a contiguous region 706 interrupted by a plurality of regularly-spaced hollow portions 708. In this example, eight wedge-shaped hollow portions regularly interrupt contiguous region 706 and have widths which decrease as the hollow portions are traversed radially inward toward central axis 114. Thus, in this configuration, a greater portion of rear surface 705 is hollow than solid, endowing contiguous region 706 with a spoke-like geometry having a plurality of spokes (e.g., spoke 710) with rectangular profiles whose widths increase as the spokes are traversed radially outward.

The hollow portions provide open regions through which heat generated in coil portions (not shown) and transferred to housing 702 may be dissipated into externally surrounding air via pumping motion of a diaphragm (not shown) when actuated. As a non-limiting example, loudspeaker 704 enclosed by housing 702 may be installed in an interior door panel of an automobile. What would otherwise be perceived as the diaphragm is perceived as a sleek, contoured speaker housing. Further, loudspeaker 602 of FIG. 6 may be enclosed by housing 702, though housing 702 may be adapted for non-inverted loudspeakers.

Figure 8:
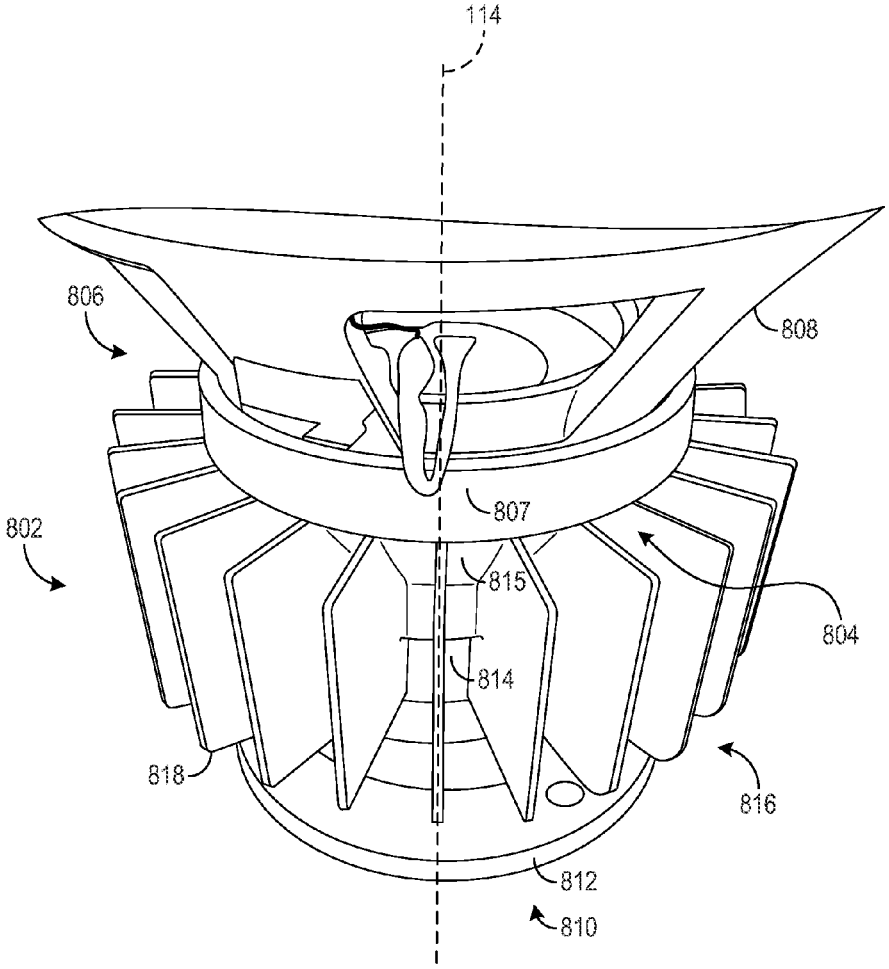
FIG. 8 is a perspective view of a heat sink structure affixed to a loudspeaker in accordance with one or more embodiments of the present disclosure.

Turning now to FIG. 8, a perspective view of an embodiment of a heat sink structure 802 is shown. Heat sink structure 802 is shown as being affixed to a rear surface 804 of a housing 806 of a loudspeaker 808, a portion of which is shown in the depicted example. Here, rear surface 804 of housing 806 is formed by a circular disk 807 having a flat surface to which a body 810 of heat sink structure 802 is affixed. At a rear region of heat sink structure 802 (e.g., toward a lower end of central axis 114 in FIG. 8), body 810 comprises a circular base 812 whose diameter is substantially similar to the diameter of disk 807 (e.g., within several cm), though these diameters may be suitably adjusted. Base 812 may serve as a surface to which additional heat-dissipating structures may be affixed, though the base may be optionally omitted to reduce mass. Body 810 further includes a core 814 which is a cylindrical structure having an upper conical section 815. Core 814 is affixed to base 812 at its rear end, and is further affixed to disk 807 at its front end opposite the rear end. In some embodiments, at least a portion of core 814 may be hollow and annular to reduce loudspeaker weight.

Coupled to body 810 of heat sink structure 802 is a plurality of fins 816, which may be integrally formed with the body (e.g., via casting). Fins 816 are flat, partially rectangular elements substantially aligned to central axis 114 extending radially outward from the central axis and downwardly below rear surface 804. As shown, the inner edges of fins 816 may be curved and contoured to the exterior surface of core 814 and particularly to upper conical section 815 such that the radial lengths of the fins decrease at heights intersecting the conical section. Fins 816 may further have beveled lower edges proximate base 812 (e.g., beveled edge 818). The geometry of fins 816, however, is provided as an illustrative example and is not intended to liming in any way. A variety of fin geometries may be used which increase heat-dissipating surface area.

As with housing 806, heat sink structure 802 is comprised of a thermally-conductive material which may include elements such as aluminum, iron, silicon, manganese, magnesium, tungsten, and carbon. In particular, fins 816 significantly increase the surface area of housing 806 and thus the amount of heat dissipation it is capable of. This heat dissipation in housing 806 is enhanced by air movement around and throughout loudspeaker 808 caused by diaphragm pumping motion. Generally, heat sink structure 802 is configured to dissipate heat generated by magnet movement (e.g., motion in magnet 124 as it is actuated) and/or heat generated in coil portions (e.g., first and second coil portions 138 and 140). As such, heat sink structure 802 may be said to be in thermal contact with the coil portions. Further, as described above, in some embodiments the coil portions may be coupled to and in direct contact with a surface of housing 806. In this configuration, housing 806 may be said to be in direct thermal contact with the coil portions.

The configurations illustrated in FIGS. 1-8 generally depict elements of a moving magnet dual coil loudspeaker in accordance with embodiments of the present disclosure. FIG. 1 shows an embodiment of such a loudspeaker while FIG. 2 schematically shows elements of an electromagnetic drive unit operable to drive the loudspeaker of FIG. 1. FIG. 3 shows an embodiment of an integrated coupler-diaphragm which may be coupled to the surround, magnet, and sheath of FIG. 1 and driven to produce acoustic vibrations. FIG. 4 shows an embodiment of an inverted coupler-diaphragm which may be used in combination with an electromagnetic drive unit disposed in an inverted configuration to produce an inverted loudspeaker. FIG. 5 shows an embodiment of a non-inverted loudspeaker comprising a plurality of ribs formed on the front surface of its diaphragm. Similar ribs may be formed on the surfaces of the diaphragms shown in FIGS. 1, 3, and 4. FIG. 6 shows an embodiment of an inverted loudspeaker which may incorporate the inverted diaphragm of FIG. 4 along with an inverted drive unit. FIG. 7 shows an embodiment of a loudspeaker positioned in a housing. The loudspeaker may be the inverted loudspeaker shown in FIG. 6. FIG. 8 shows an embodiment of a heat sink structure affixed to a loudspeaker such as the loudspeaker shown in FIG. 1. FIGS. 1 and 3-8 are drawn to scale for embodiments in accordance with the present disclosure, though other relative dimensions may be used.

Figure 9:
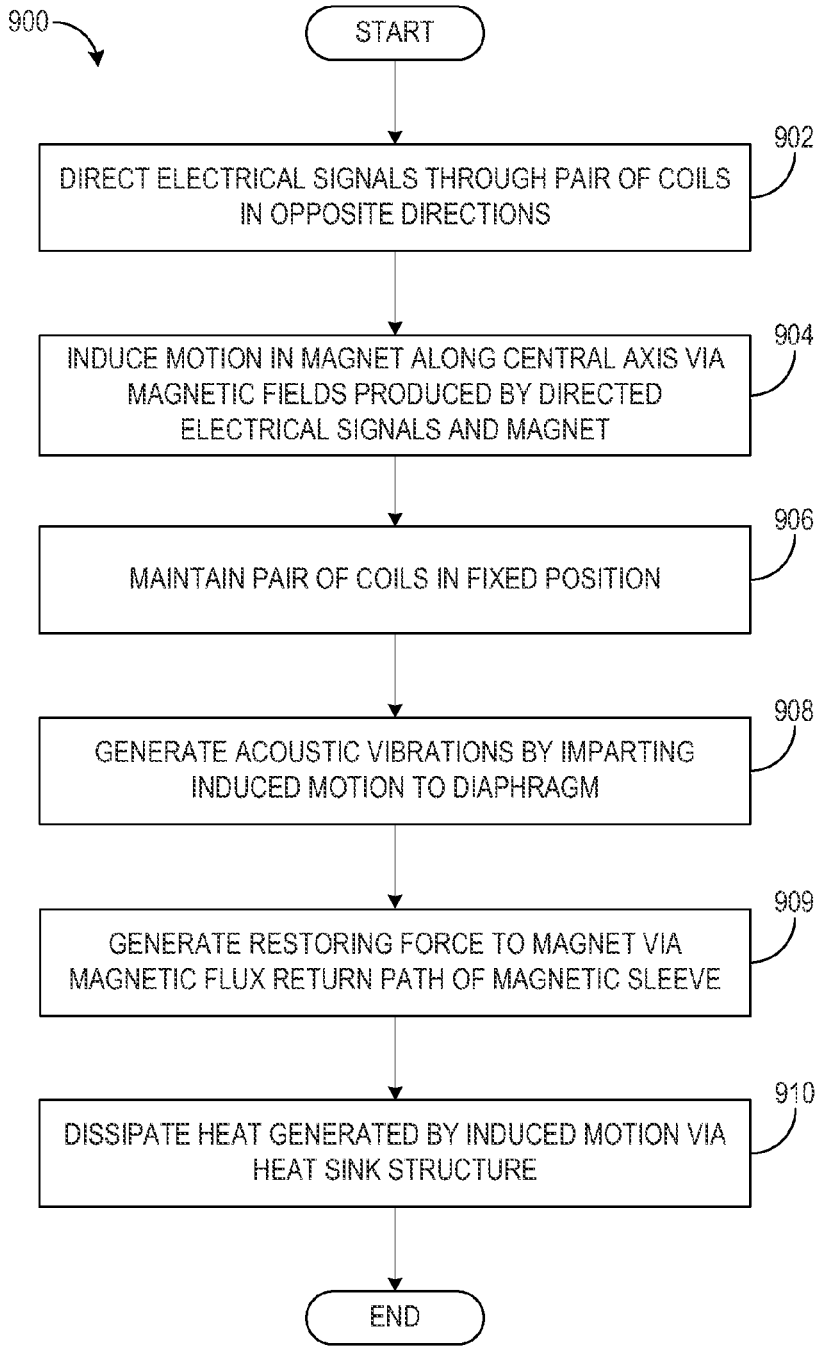
FIG. 9 shows a flowchart illustrating a method for driving a loudspeaker in accordance with one or more embodiments of the present disclosure.

Turning now to FIG. 9, a flowchart illustrating a method 900 for driving a loudspeaker having dual coils and a moving magnet in accordance with embodiments of the present disclosure is shown. Loudspeakers 100 and 602 respectively shown in FIGS. 1 and 6 may be driven according to method 900, for example, though other loudspeakers may also be driven according to the method.

At 902 of method 900, electrical signals are directed to a pair of coils in opposite directions. In some embodiments, the pair of coils may include a first coil portion wound in a first direction (e.g., clockwise), and a second coil portion vertically separated from the first coil portion and wound in a second direction (e.g., counter-clockwise) opposite the first direction. Such oppositely wound coils may be formed from a single conductive wire (e.g., comprised of copper) having a return end and a send end which are respectively connected to leads from an audio source (e.g., stereo amplifier). Alternatively, the pair of coils may include electrically-isolated coil portions each driven by respective amplifiers operating in reverse phase with respect to each other.

Next, at 904 of method 900, motion along a central (e.g., vertical) axis is induced in a permanent magnet concentrically surrounded and vertically interposed between the pair of coils. Particularly, magnetic fields arising from directed electrical signals propagating through the coil portions interact with the magnetic field emanating from the permanent magnet to induce motion in the magnet along the central axis. Induced magnet motion may be constrained to the central axis via a linear bearing, for example. The linear bearing may include a shaft embedded in a loudspeaker housing, with a sleeve in sliding contact with the shaft and coupled to the magnet.

Next, at 906 of method 900, the pair of coils is maintained in a fixed position while inducing motion in the magnet. In contrast to other loudspeaker and electroacoustic transducer configurations, electrical signals received from an audio source propagating throughout coils induce motion in the magnet and not the coils. In this configuration, cooling may be made more efficient due to fixed positioning of the coils, the need for a spider is obviated, reduced loudspeaker output due to a reduction in magnet mass may be compensated with dual coils, and coil rub against proximate surfaces may be eliminated.

Next, at 908 of method 900, acoustic vibrations are generated by imparting induced motion in the magnet to a diaphragm in the loudspeaker. This may be accomplished by conveying induced motion magnet to a coupler affixed to the magnet, and conveying this motion to the diaphragm via its connection to the coupler. In this manner, the diaphragm may vibrate and thus produce acoustic vibrations responsive to the electrical signals applied to the dual coils.

Next, at 909 of method 900, a restoring force is generated and conveyed to the magnet via a magnetic sleeve (e.g., sleeve 142 in FIG. 1) concentrically surrounding the magnet. As described above, a magnetic sleeve provides a return path for magnetic flux lines extending from the magnet, allowing the magnet to be operated as a magnetic spring which naturally assumes a neutral position when at rest (e.g., at times in which electrical signals are not applied to the coils).

Finally, at 910 of method 900, heat generated in the loudspeaker by induced motion in the magnet is dissipated via a heat sink structure affixed to the loudspeaker housing. This heat may be dissipated by the housing itself, as well. Both the heat sink structure and the housing may be comprised of thermally conductive materials such as aluminum, for example. The heat sink structure may include a plurality of fins which increase the surface area of the structure and housing and thus heat dissipation.

By driving a loudspeaker with an electromagnetic drive unit comprising stationary dual coils and a moving magnet, output of the loudspeaker may be maximized while minimizing potential points of degradation and magnet mass. What in some configurations might otherwise be a limiting factor in loudspeaker output—making the magnet and not the coils a moveable element—facilitates hi-fidelity reproduction of audio at high volumes while allowing for more effective dissipation of heat generated in the coils. As the coils remain stationary, coil rub against proximate surfaces is obviated as is the need for a spider membrane which facilitates guided coil motion. Magnet mass is further reduced to increase speaker output by employing greater coil length in the dual configuration. In some embodiments, a magnet comprised of a material having a high magnetic flux density may be used, such as a neodymium alloy.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. An electromagnetic transducer, comprising:

a diaphragm configured to generate acoustic vibrations;

a moving magnet affixed to the diaphragm;

a pair of fixed coils surrounding the moving magnet, the fixed coils configured to direct electrical current in opposite directions;

a magnetic sleeve directly coupled to at least a portion of the fixed coils via a coil-facing surface of the magnetic sleeve and to a housing of the electromagnetic transducer via another surface of the magnetic sleeve, the magnetic sleeve configured to generate a restoring force to magnet movement by providing a return path for magnetic flux lines of the magnet; and a heat sink structure in thermal contact with the pair of fixed coils via the magnetic sleeve.

2. The electromagnetic transducer of claim 1, wherein the magnetic sleeve concentrically surrounds the magnet.

3. The electromagnetic transducer of claim 1, wherein the housing at least partially encloses the electromagnetic transducer, and wherein the heat sink structure is affixed to a rear surface of the housing at a rear end of the electromagnetic transducer.

4. The electromagnetic transducer of claim 3, wherein the heat sink structure comprises a plurality of fins configured to dissipate heat generated by magnet movement.

5. The electromagnetic transducer of claim 3, wherein the fixed coils are wound in opposite directions.

6. The electromagnetic transducer of claim 1, wherein the fixed coils are driven by respective amplifiers, the amplifiers in reverse phase with respect to each other.

7. The electromagnetic transducer of claim 1, wherein the housing at least partially encloses the electromagnetic transducer, and the electromagnetic transducer further comprising a linear bearing affixed to a rear end of the housing and extending along a central axis through a bore of the magnet, the magnet undergoing induced motion along the central axis via the linear bearing upon receiving electrical signals at the fixed coils.

8. The electromagnetic transducer of claim 1, further comprising a front pole piece and a rear pole piece respectively disposed on a front surface and a rear surface of the magnet.

9. The electromagnetic transducer of claim 1, wherein the diaphragm extends concavely inward below a front surface of a surround, the surround affixed to the diaphragm.

10. The electromagnetic transducer of claim 1, wherein the diaphragm extends convexly outward above a front surface of a surround, the surround affixed to the diaphragm.

11. The electromagnetic transducer of claim 1, further comprising a coupler affixed to the diaphragm and the magnet.

12. The electromagnetic transducer of claim 1, wherein the housing at least partially encloses the electromagnetic transducer, the housing including a contiguous rear surface interrupted by a plurality of regularly-spaced hollow portions.

13. An electromagnetic transducer, comprising:

a surround affixed to a housing;

a diaphragm affixed to the surround, the diaphragm configured to produce acoustic vibrations;

a coupler affixed to the diaphragm;

a permanent magnet affixed to the coupler, the permanent magnet having a bore aligned to a central axis;

a coil comprising a first coil portion and a second coil portion, the first and second coil portions concentrically surrounding the permanent magnet and configured to induce motion in the permanent magnet about the central axis responsive by directing electrical signals in opposite directions;

a magnetic sleeve surrounding the permanent magnet, the magnetic sleeve being interposed between and in contact with the coil via a coil-facing surface of the magnetic sleeve and an inner portion of the housing via a surface of the magnetic sleeve opposite the coil-facing surface;

a heat sink structure affixed to a rear surface of the housing and in thermal contact with the coil via the magnetic sleeve; and a linear bearing coupled to the magnet, the linear bearing constraining induced magnet motion to a central axis of the electromagnetic transducer.

14. The electromagnetic transducer of claim 13, wherein the first coil portion and the second coil portion are maintained in a fixed position with respect to the housing.

15. The electromagnetic transducer of claim 1, further comprising a coupler integrally formed with the diaphragm, the integrally-formed diaphragm and coupler comprised of one of injection-molded plastic and drawn aluminum.

16. The electromagnetic transducer of claim 13, wherein the coupler, the permanent magnet, and the first and second coil portions are positioned such that motion induced in the permanent magnet and the diaphragm generates acoustic vibrations propagating toward a front surface of the surround, the surround affixed to the diaphragm.

17. The electromagnetic transducer of claim 13, wherein the coupler, the permanent magnet, and the first and second coil portions are positioned such that motion induced in the permanent magnet and the diaphragm generates acoustic vibrations propagating away from a front surface of the surround, the surround affixed to the diaphragm.

18. The electromagnetic transducer of claim 13, further comprising a plurality of ribs positioned on a surface of the diaphragm, the plurality of ribs extending radially outward from the coupler to a corrugation of the surround, the diaphragm affixed to the coupler at a first end and affixed to the surround at a second end.

19. A method for driving an electromagnetic transducer, comprising:

directing electrical signals through a pair of coils in opposite directions;

inducing motion in a permanent magnet via magnetic fields produced by the directed electrical signals and the permanent magnet, the induced motion constrained to a central axis via a linear bearing, the linear bearing affixed to a rear surface of a housing;

generating, with a magnetic sleeve directly coupled to the pair of coils and a housing of the electromagnetic transducer, a restoring force to magnet movement by providing a return path for magnetic flux lines of the permanent magnet;

maintaining the pair of coils in a fixed position;

generating acoustic vibrations by imparting the induced motion to a diaphragm coupled to the permanent magnet; and transferring heat generated in the pair of coils to the housing via the magnetic sleeve and to a heat sink via the housing.

20. The method of claim 19, further comprising:

dissipating heat generated by the induced permanent magnet motion and heat generated in the pair of coils via the heat sink structure, the heat sink structure being affixed to the rear surface of the housing.

* * * * *